US006526999B2

(12) United States Patent
Tebbe

(10) Patent No.: US 6,526,999 B2
(45) Date of Patent: Mar. 4, 2003

(54) RANDOM HIGH PRESSURE WATER JETTING NOZZLE FOR CLEANING CASTINGS

(76) Inventor: Joseph J. Tebbe, 3682 White Bear Ave., White Bear Lake, MN (US) 55100

( * ) Notice: Subject to any disclaimer, the term of this patent is extended or adjusted under 35 U.S.C. 154(b) by 85 days.

(21) Appl. No.: 09/845,121

(22) Filed: Apr. 30, 2001

(65) Prior Publication Data

US 2002/0157690 A1 Oct. 31, 2002

(51) Int. Cl.[7] ..... B08B 3/02

(52) U.S. Cl. ..... 134/58 R; 134/99.1; 134/140; 134/144; 134/153; 134/181; 134/200

(58) Field of Search ..... 134/58 R, 57 R, 134/94.1, 99.1, 140, 144, 153, 181, 200

(56) References Cited

U.S. PATENT DOCUMENTS 1,848,436 A * 3/1932 Shaw
1,861,428 A * 5/1932 Furnas
2,224,647 A * 12/1940 Grocholl
2,628,455 A * 2/1953 Webster
2,943,799 A * 7/1960 Bodmer
3,411,518 A * 11/1968 Fisher et al.
3,439,689 A * 4/1969 Zardon et al.
3,805,317 A * 4/1974 Dickinson
3,952,756 A * 4/1976 Sheppard
3,986,671 A * 10/1976 Nugent
4,164,198 A * 8/1979 Sheinin et al.
4,350,174 A * 9/1982 Bolten et al.
4,501,313 A * 2/1985 Weis et al.
4,688,586 A * 8/1987 Weis et al.
4,741,351 A * 5/1988 Minkin
4,859,249 A * 8/1989 Valentini
5,195,548 A * 3/1993 Roger
5,932,026 A * 8/1999 Trampusch
6,113,707 A * 9/2000 Benea et al.
6,378,535 B1 * 4/2002 Miyachi et al.

FOREIGN PATENT DOCUMENTS

GB 1818930 * 2/1970
GB 2045888 * 11/1980
JP 6-285436 * 10/1994

OTHER PUBLICATIONS

WO 91/02600 Mar. 1991.*

* cited by examiner

*Primary Examiner*—Frankie L. Stinson
(74) *Attorney, Agent, or Firm*—Herman H. Bains

(57) ABSTRACT

An apparatus for cleaning castings includes a cleaning cabinet having a rotary clamping device which clamps a casting to be cleaned upon a freely rotatable plate in the cabinet. An elongate lance having a high pressure nozzle at its inner end projects into the cabinet and delivers a high pressure water jet against the casting at a pressure of 1,000 psi to 40,000 psi. A spherical bearing pivotally and rotatably mounts the lance on a vertically reciprocal carriage. A pair of pneumatic cylinder and piston units are connected to lance and are differentially operated with respect to actuation times and length of piston stroke to thereby produce random movement of the lance during the cleaning operation.

17 Claims, 4 Drawing Sheets

RANDOM HIGH PRESSURE WATER JETTING NOZZLE FOR CLEANING CASTINGS

FIELD OF THE INVENTION

This invention relates to an apparatus for cleaning castings.

BACKGROUND OF THE INVENTION

Cleaning apparatus for cleaning castings has been developed and are commercially available. These prior art cleaners use high pressure water for cleaning the investment castings. However, with large castings, a substantial amount of refractory material must be removed and this material is usually removed first by a manual procedure (mechanical knockout with air hammer) before the final mechanical (high pressure water) cleaning. The manual step is time consuming, exposes the operator to dangerous airborne silica dust and sometimes results in damage to the cast device. The present system rapidly and effectively removes all the refractory material and cleans investment castings while eliminating any airborne silicon dust and danger of damaging the casting. The invention improves safety and environmental problems and improves ergonomic and body stress issues related material removal by the manual procedure. The invention also improves productivity and produces a higher quality cleaning of castings eliminating mechanical knockout, shot blasting, sandblasting and chemical removal of refractory.

SUMMARY OF THE INVENTION

It is an object of this invention to provide a novel cleaning apparatus which rapidly and effectively cleans investment castings.

A more specific object of this invention is to provide a casting cleaning system including a single high pressure nozzle which is continuously moved in a random manner while the casting is rotated in opposite directions to cause rapid and complete cleaning of the casting in a matter of minutes.

The apparatus includes a cleaning cabinet in which the casting to be cleaned is positioned. The casting is clamped between a rotary clamp and a freely rotatable table. The rotary clamp rotates in opposite directions during the cleaning operation. A single elongated lance having a nozzle at its inner end directs high pressure water against the casting. The lance is mounted for pivotal and rotative movement by a gimbal type spherical bearing and is moved in a random or stochastic manner and produces complete and rapid cleaning of the casting.

DESCRIPTION OF THE PREFERRED EMBODIMENT

Figure 1:
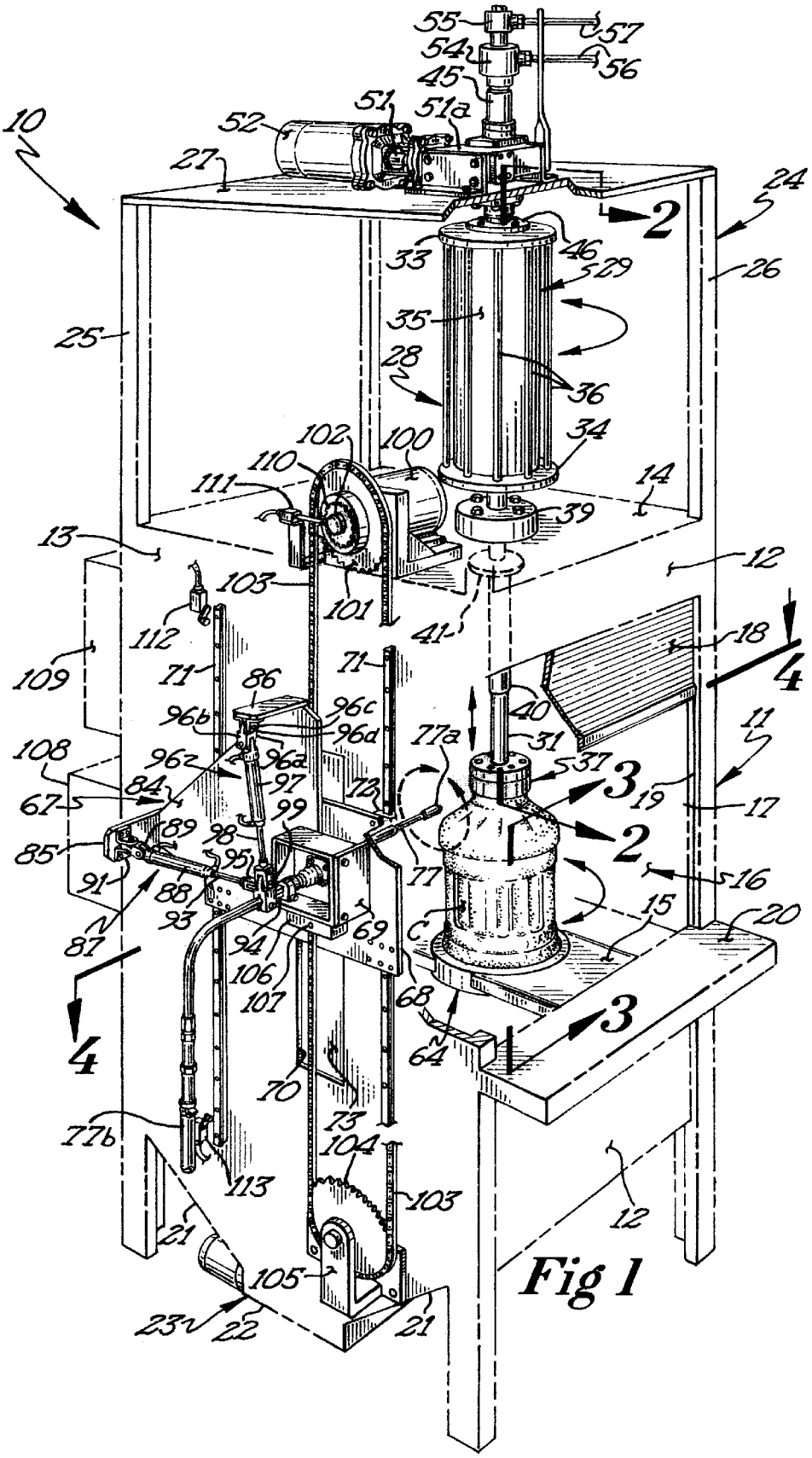
FIG. 1 is perspective view of the novel cleaning apparatus with certain parts broken away for clarity.
Figure 3:
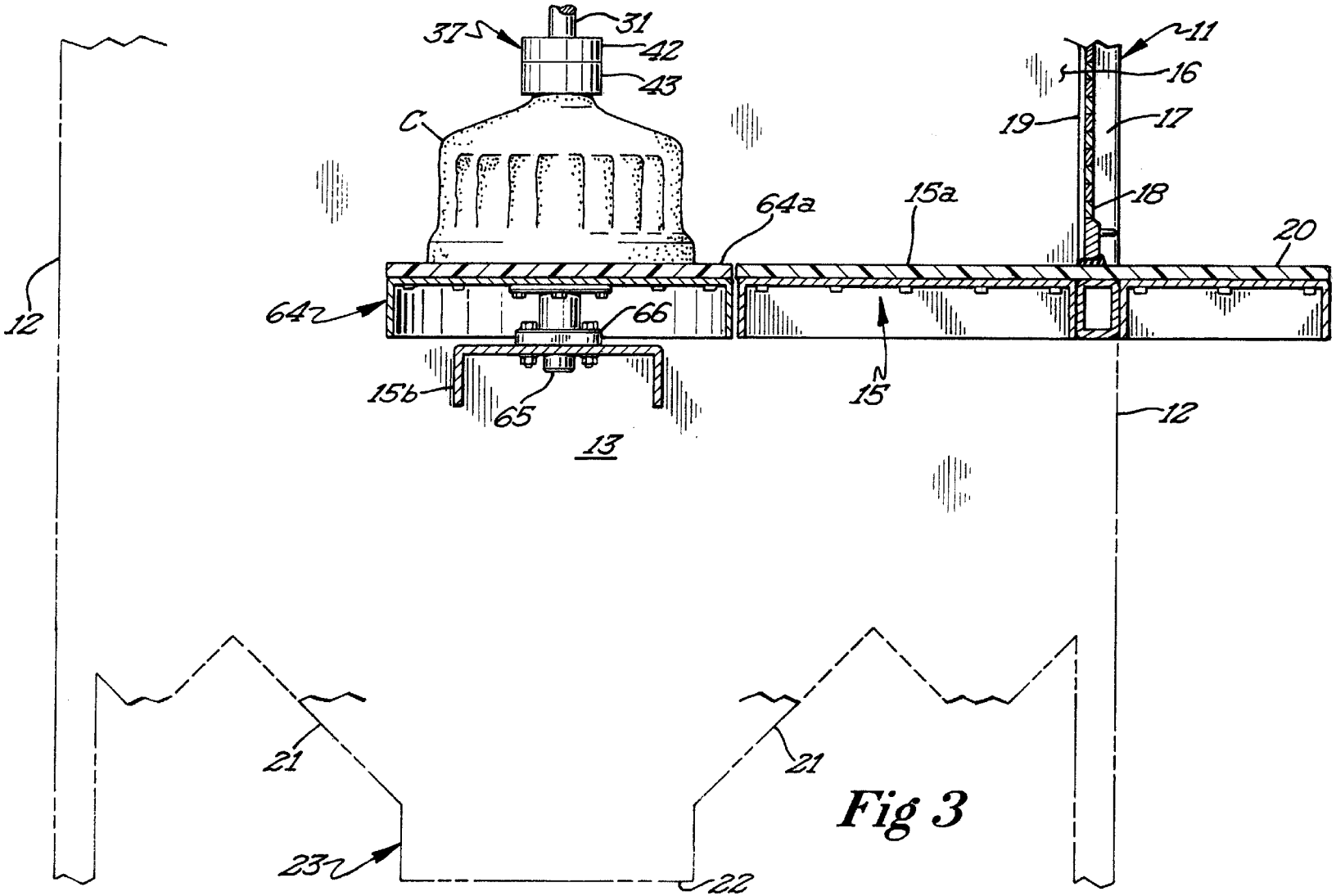
FIG. 3 is a cross-sectional view taken along lines 3—3 of FIG. 1 and looking in the direction of the arrows.
Figure 4:
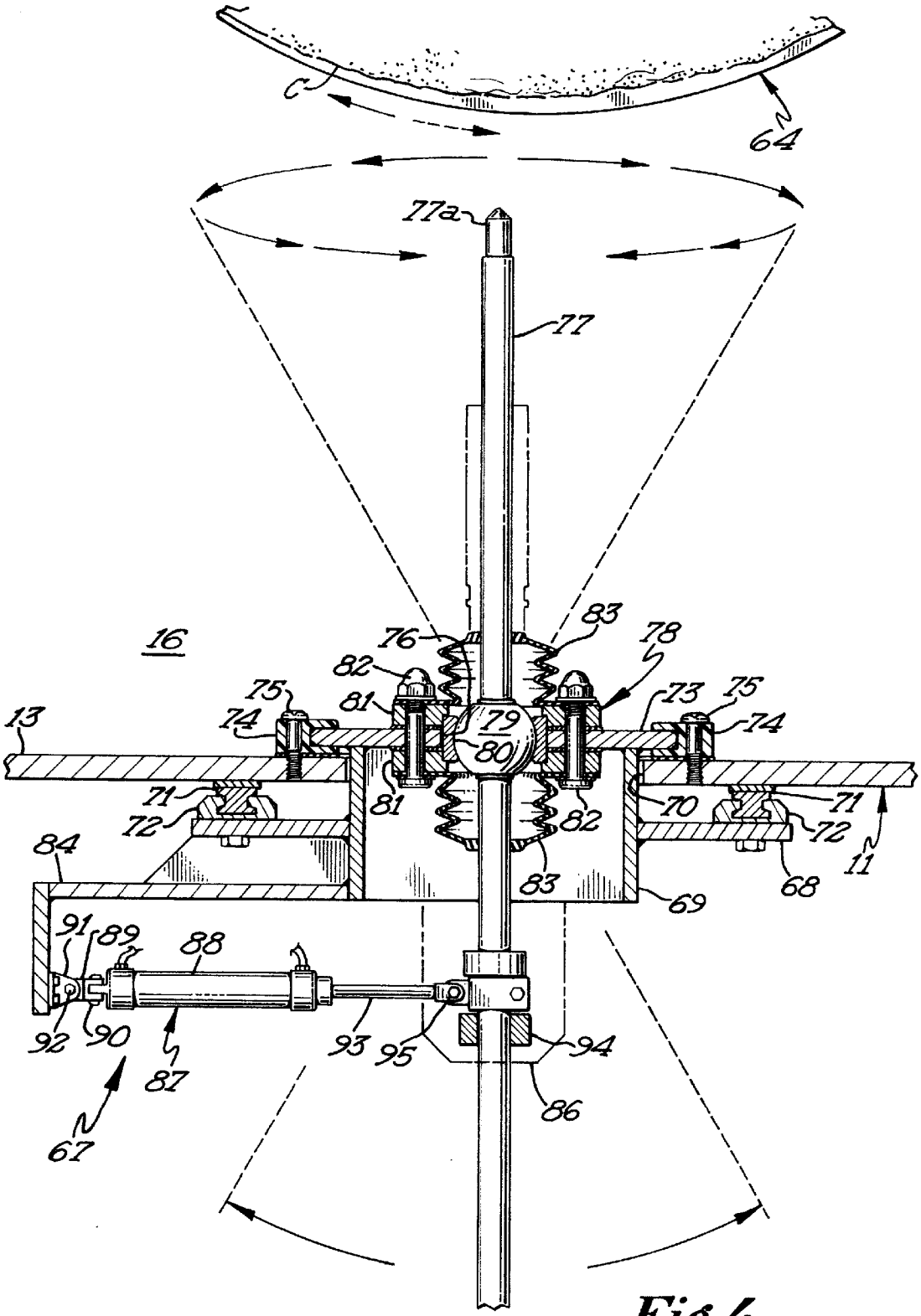
FIG. 4 is a cross-sectional view taken along FIG. 1 and looking in the direction of the arrows.

Referring now to the drawing and more particularly to FIG. 1, it will be seen that one embodiment of my novel casting cleaning apparatus, designated gererally by the reference numeral 10, is thereshown. The cleaning apparatus 10 comprises a generally rectangular shaped cabinet 11 which includes opposed end walls 12, opposed side walls 13 and a top wall 14. A support plate 15 is secured to one of the side walls 12 and projects interiorly of the cabinet for supporting a casting during loading and unloading of the casting. The support plate 15 is provided with a cover element 15*a*, shown in FIG. 3, which is made of an abrasive resistant material. A channel-shaped support member 15*b*, as seen in FIG. 3, extends between the side wall 13 and supports a lazy susan type support which will be described hereinbelow.

The interior of the cabinet defines a cleaning chamber 16 wherein the cleaning operation takes place. One of the end walls 12 has an access opening 17 therein, and a metallic door 18 is provided for closing the opening. The door is vertically shiftable in tracks 19 into a roll when shifted to the open position. The access opening allows loading and removal of a casting from the cabinet. A support ledge 20 adjacent the lower edge of the opening 17 provides a support for facilitating loading of a casting in the cabinet. The support ledge 20 is also provided with an abrasive resistant cover element.

The side walls 13 of the cabinet 11 converge downwardly at the lower end of the cabinet to define a hopper for containing an endless drag conveyor 23. The drag conveyor 23 is supported on a bottom wall 22 of the cabinet. The drag conveyor removes the waste material removed from the casting.

Figure 2:
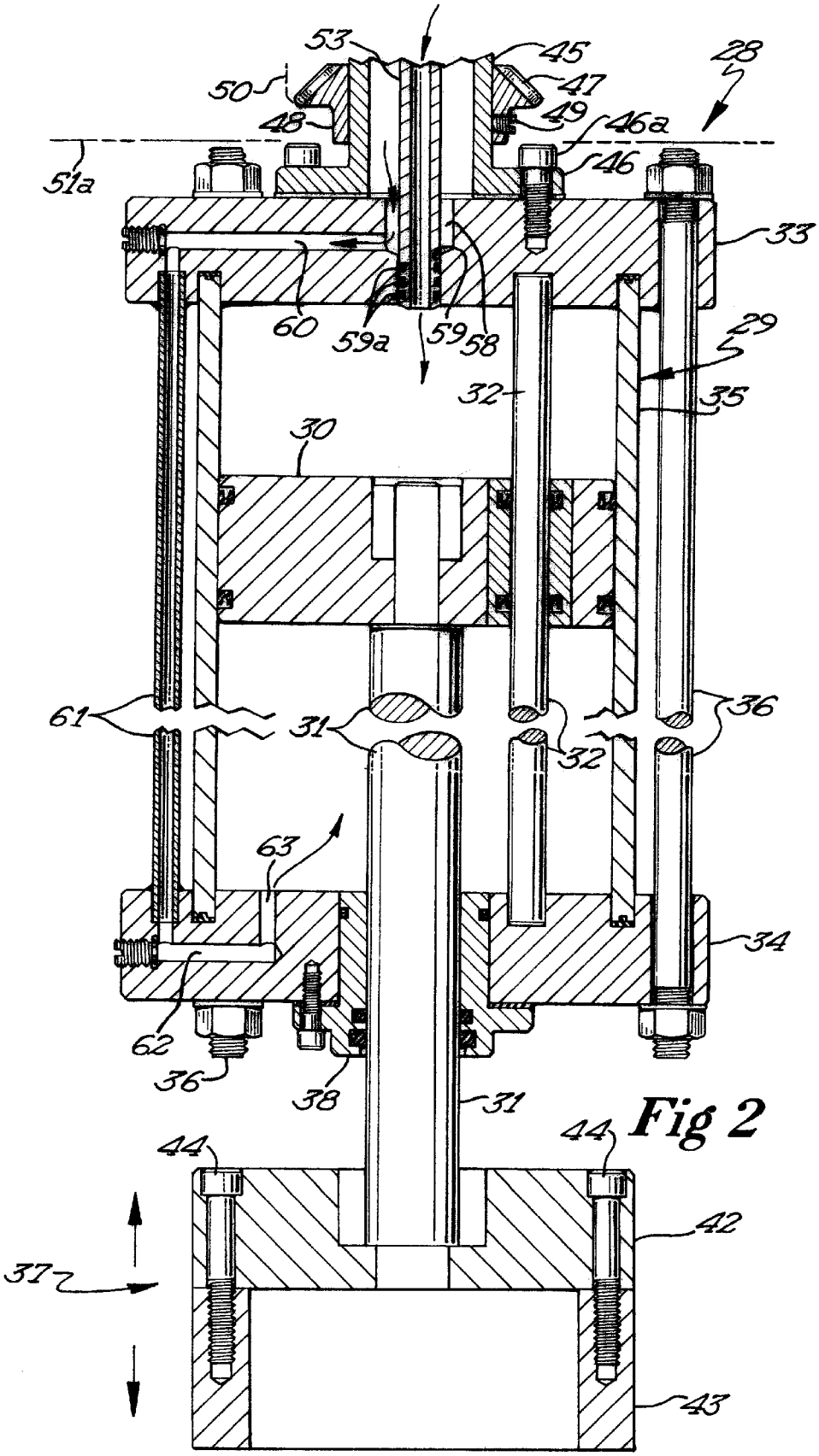
FIG. 2 is a vertical cross-sectional view taken along line 2—2 of FIG. 1 and looking in the direction of the arrows and foreshortened for clarity.

The casting cleaning apparatus also includes an auxiliary housing 24 positioned upon the top wall 14 of the cabinet. The auxiliary housing 24 includes opposed end walls 25, opposed side walls 26 and a top wall 27. A rotary clamp device 28 is positioned within the auxiliary housing 24 and includes a vertically disposed cylinder 29. The rotary clamp device 28 is a double-acting pneumatically operated unit and a piston 30 is positioned within the cylinder and is moveable therein. A piston rod 31 has one end secured to the piston 30 and projects downwardly through an opening in the top wall 14 of the cabinet into the cleaning chamber 16. The cylinder 29 includes an upper plate 33, a lower plate 34 and a cylindrical body 35. A pair of guide rods 32 (only one shown in FIG. 2) extend between and are connected to the upper and lower plates of the cylinder. The guide rods 32 project through openings in the piston.

The clamp device 28 is rotated in opposite directions during the cleaning operation and the guide rods 32 prevent the piston 30 from rotating relative to the cylinder 29. The lower end of the piston rod has a holding cup 37 secured thereto for rotation therewith.

The lower end of the cylinder 29 is provided with a seal 38 positioned to form a seal where the piston rod projects through the opening in the lower plate 34 of the cylinder. The piston rod 31 projects through a bearing 39 secured to the upper surface of the top wall 14 of the cabinet 11. A sleeve type bearing protector 40 is provided and includes an outturned flange 41 which is bolted to the under side of the top wall 14 of the cleaning cabinet 11. The piston rod 31 projects through the bearing sleeve protector 40 and debris generated in the cleaning operation is prevented from damaging the bearing 39.

The holding cup 37 is adapted to engage and hold a casting to be cleaned. The holding cup includes an upper annular element 42 formed of steel and secured to the lower end of the piston rod. A cylindrical lower element is formed of aluminum and is bolted to the upper element 42 by bolts 44. The lower element 43 engages the casting to be cleaned and its softer aluminum composition minimizes damage to the casting.

The rotary clamp device 28 is provided with a vertically disposed drive tube 45 which is provided with a mounting flange 46 at its lower end which is bolted to the upper plate 33 of the cylinder 29. The rotary drive tube 45 has a bevel gear 47 secured thereto adjacent the lower end thereof by means of a set screw 49.

The driven bevel gear 47 is engaged by a drive bevel gear 50 positioned within a gear box 51*a*. The drive gear is connected to the output shaft 51 of a electric motor 52. The electric motor 52 is reversible and is conveniently mounted on the top wall 27 of the auxiliary housing 24. It will be seen that when the motor 52 is energized, the rotary clamp device 28 will be rotated via the drive tube 45 in one direction, and when the motor 52 is reversed, the rotary clamp device and casting will be rotated in the opposite direction.

Means are provided for shifting the piston rod 31 of the rotary clamp device between clamping and release positions. It is pointed out that the drive tube 45 also constitutes an air supply conduit for the cylinder 29. An elongate inner airline or conduit 53 is positioned interiorly of the drive tube 45. The upper end of the drive tube 45 is connected in communicating relation to supply conduit 56 by means of a rotary union 54. The upper end of the inner air line 53 is connected in communicating relation with a supply conduit 57 by means of a second rotary union 55. Details of construction of the rotary unions are not shown since such rotary unions are commercially available. During rotation of the clamp device, the drive tube 45, inner airline 53 and certain components of the rotary unions 54, 55 are rotated.

When air under pressure is supplied through the inner air line 53 the piston 30 is moved downwardly into the clamping position. When air is supplied through the drive tube 45 the piston 30 is moved in an upward or retractive direction thereby releasing the casting. It will be seen that the inner airline 53 communicates directly at its lower end with the interior of the cylinder 29. It will be seen that the lower end of the airline 53 is press fitted into an opening 59 in the upper plate 33 of the cylinder. Suitable o-ring seals 59*a* are provided for insuring a sealed relation between the air line 53 and upper plate 33.

The lower end of the drive tube 45 communicates with an enlarged opening 58 in the upper plate 33 of the cylinder 29. A transverse passage 60 communicates with the opening 58 and with the upper end of a vertical air line or tube 61. The lower end of the air line 61 communicates with a transverse passage 62 in the lower plate 34 of the cylinder 29. The ends of the air line 61 are pressed into the upper and lower plates of the cylinder. The transverse passage 62 communicates with the interior of the cylinder 29 via the port 63. When air under pressure is directed through the drive tube 45, the piston rod will move upwardly or in a release direction.

It will be seen that the casting to be cleaned is clamped between the holding cup 37 and a freely rotatable table or lazy susan plate 64. The lazy susan plate 64 is provided with a centrally located stem 65 which extends therefrom and engages a ball bearing 66. The bearing 66 is secured to the support member 15*b*. Since the lazy susan support plate is freely rotatable, the clamped casting will be rotated in response to rotation of the clamp device.

The casting cleaning apparatus 10 is provided with a moveable lance assembly 67. The lance assembly 67 includes a generally rectangular mounting plate 68 having a generally rectangular shaped (parallelepiped) housing 69 secured thereto. It will be seen that the housing 69 projects through an opening in the mounting plate 68 and is welded thereto. The rectangular housing 69 also projects through a vertically extending elongate rectangular opening 70 in a side wall of the cabinet 11. The inner peripheral edges of the housing 69 are rigidly affixed to a vertically extending, elongate rectangular support plate 73. The support plate 73 is positioned interiorly of the cabinet 11.

The mounting plate 68 is provided with a pair of track engaging guides 72 which engage a pair of guide tracks 71 secured to a side wall 13 of the cabinet. Opposite vertical edges of the support plate 73 engage vertical guides 74 in sealing relation. The guides 74 are formed of a yieldable material and therefore also function as seals. The guides 74 are secured to the inner surface of a side wall 13 of the cabinet by suitable bolts 75. The support plate 73 also serves to close the opening 70 in the side wall 13.

The support plate 73 has an opening 76 therein through which projects an elongated lance 77. The central portion of the lance has a spherical or gimbal bearing assembly 78 secured thereto. The spherical bearing assembly 78 comprises a spherical bearing element 79 positioned in a race 80 clamped between bearing plates 81. Suitable bolts 82 secure the bearing plates to the support plate 73. Bellows type boots 83 engage the lance 77 on opposite sides of the bearing assembly 78 to form seals thereat.

A bracket plate 84 is fixedly secured to one side of the housing 69 and projects outwardly therefrom. The bracket plate 84 has attachment elements 85 and 86 integral therewith and extending outwardly at right angles therefrom as best seen in FIG. 1. A double-acting pneumatic piston and cylinder unit 87 is secured to the attachment element 85 and projects generally laterally therefrom. The pneumatic piston and cylinder unit 87 includes a cylinder 88 which has an intermediate clevis 89 pivotally connected to the cylinder 88 by a pivot 90. The intermediate clevis 89 is pivotally connected by a pivot 92 to a mounting clevis 91 which is attached to the attachment element 85 as shown in FIG. 1. The cylinder 88 is provided with piston (not shown) and a piston rod 93 which is pivotally connected by a pivot 95 to a mounting block 94 secured to the lance 77. The pivots 90 and 92 for the cylinder 88 allow a universal type movement during operation of unit 87.

A double acting pneumatic piston and cylinder unit 96 is pivotally connected to attachment element 86 and extends generally downwardly therefrom. The piston and cylinder unit 87 is angularly related to the piston and cylinder unit 96. An intermediate clevis 96*a* is pivotally connected by a pivot 96*b* to the cylinder 97 of the piston and cylinder unit 96. The intermediate clevis 96*a* is pivotally connected by a pivot 96*d* to a mounting clevis 96*c* secured to the attachment element 86. The piston and cylinder unit 96 is provided with a piston and piston rod 98 which pivotally connected to mounting block 94 by a pivot 99. It will be noted that the cylinder 97 also has a universal type connection to the attachment element 86. Extension and retraction of the piston rods for the piston cylinder units 87 and 96 cause pivoting and rotative movement of the lance 77.

Means are provided for vertically shifting the lance assembly in up and down directions. This means includes a reversible electric motor 100 which is mounted on the top wall 14 of the cabinet 11. The output shaft 102 of the electric motor has a drive sprocket 101 affixed thereto. An elongated drive chain 103 is trained about the drive sprocket 101 and about a driven sprocket 104 mounted on the lower portion of the adjacent side wall 13 by a mounting bracket 105.

One end of the drive chain 103 is connected to a mounting bracket 106 by a pin 107. The mounting bracket 106 is secured to a lower wall of the rectangular housing 69 of the lance assembly. The other end of the chain 103 is connected to the upper right corner portion of the mounting plate 68 as viewed in FIG. 1. It will be seen that when electric motor 100 is energized, the lance assembly 67 will be vertically shifted. Alternate reversible of the electric motor 100 will cause reciprocal vertical movement of the lance assembly between upper and lower limit switches.

During operation of the casting cleaning apparatus, the casting will be clamped against the lazy susan plate by the holding cup of the rotary clamp device 28. It is believed that shifting movement of the rotary clamp device 29 between clamping and release positions is apparent from description above. During the cleaning operation, the electric motor 52 will be alternately driven in opposite directions thereby rotating the casting in opposite directions.

The operation of the various units of the cleaning apparatus is controlled by a control unit 108, namely a computer, which is preprogrammed to give optimum cleaning for the particular casting to be cleaned. The computer 108 is provided with suitable software which allows the various operational conditions to be programmed. The control unit (computer 108) is electrically connected to an operator unit 109 which contains the various actuator mechanisms for actuating the units of the cleaning apparatus. For example, the operator unit contains the solenoid valves for actuating the pneumatic cylinder and piston units 87 and 96 as well as the solenoid valve for actuating the rotary clamp device 28.

The entire cleaning cycle takes place in approximately one to six minutes, and operation of the rotary clamp device is typically programmed to reverse its rotation at half the cleaning cycle. Therefore, if the cleaning cycle is programmed to require three minutes, then the reversal takes place at 90 seconds. The operator or computer 108 programs in the height of the casting in inches. The lance assembly moves downwardly to the level of the lazy susan support plate and the computer 108(PLC) counts up to the height programmed and reciprocates between the programmed height and lazy susan support plate until the end of the cycle. The lance assembly moves upwardly to the home position wherein the lance assembly is fully elevated.

In the embodiment shown, the pneumatic piston and cylinder unit 87 ("x" axis movement) has a 3" stroke while the pneumatic piston and cylinder unit 96 ("y" axis movement) has a 4" stroke. The computer 108 has a control program which allows these pneumatic units to be rapidly operated. For example, the pneumatic unit 87 may be programmed to operate (extend or retract) every 3/10 second on the "x" axis while the pneumatic unit 96 may be programmed to operate every 1/10 second on the "y" axis. The entire lance assembly is also programmed to reciprocate vertically to the programmed casting height. The amount of linear movement of the stroke of the pneumatic cylinder units 87 and 96 may be selectively varied. The operational time for the pneumatic units 87 and 96 may also be varied in operational times of 1/10 second. The disclosed operational times of 3/10 seconds end 1/10 seconds for the units 87 and 96 are merely exemplary.

During operation of the cleaning apparatus, the lance 77 will be rapidly pivoted and rotated by the continuous and rapid operation of the pneumatic piston and cylinder units 87 and 96. For example, if the double-acting pneumatic unit 87 operates every 3/10 of a second, the piston rod 93 will extend (3/10 second) and then retract (3/10 second) while the piston rod 98 of unit 96 will extend (1/10 second) and then retract (1/10 second). It will be seen that the actuation time of the pneumatic units is both different and simultaneous during the clean cycle. Water under high pressure will be discharged through the nozzle 77*a* against the casting. The water pressure directed against the casting will be within the range of 1,000 psi to 20,000 psi. In a typical casting cleaning operation, the water pressure is preferably between 8,000 psi and 20,0000 psi. The nozzle 77*a* is fixedly connected to the lance 77 and is not rotatable in the manner of the commercial nozzles. High speed spinning nozzles usually require two nozzles to create a rotational reaction force for spinning the nozzles freely. This type of nozzle device has seal problems and the impact force of the water stream is cut in half from the need of two nozzles. Further, the commercial rotary nozzles lose water in lubrication and the high pressure rotary seals do not last at these high speeds.

The lance assembly 67 is reciprocated vertically during the cleaning operation by the electric motor 100. Since the castings to be cleaned vary in size, the amount of movement of the lance assembly 67 must be determined and programmed. In this regard, the output shaft 102 of the electric motor 100 is provided with a gear 110 which is engaged by a counter unit 111. The counter unit 111 is electrically connected to the computer 108 and counts the teeth of the gear 110 during upward movement of the lance assembly 67.

The teeth on gear 110 represent increments of movement and when the lance assembly reaches the programmed height, the electric motor is reversed and the lance assembly begins its downward movement. The downward movement continues until the lance assembly actuates a limit switch 113 which is located at the level of the lazy susan support plate 64. Actuation of the limit switch 113 reverses the motor 100. Vertical reciprocation of the lance assembly 67 continues until the programmed cleaning cycle time has been reached. The control switch (not shown) for controlling the upward movement of the counted height by the counter unit 111 is opened and the lance assembly 67 will continue its upward movement (after expiration of the cleaning cycle) until the upper limit switch 112 is actuated. Actuation of the upper limit switch 112 interrupts operation of the lance assembly. The lance assembly 67 is then in its uppermost or home position.

The supply conduit 77*b* for the lance 77 is flexible and simply flexes during the complex movement of the lance 77. The rapid periodic operation of the pneumatic unit 87 and 96 along with the difference in linear travel of the respective piston rods produces a random or stochastic pattern of the lance nozzle during the cleaning action. In this regard the lance can pivot approximately 60° in all directions thereby producing a 60° cone of potential coverage. The combined movements of the lance 77 produced by the pneumatic units 87 and 96, the vertical reciprocal movement of the lance assembly and the rotation of the rotary clamp device results in the random or stochastic movement and allows the high pressure water to hit all areas of the casting. The adjustability of the operation of the components of the cleaning apparatus permits rapid and highly efficient cleaning of castings of various sizes and shapes.

It is also pointed out that while the high water pressure lance assembly is especially adapted for cleaning casting, the lance assembly can be used in demolishing concrete or masonry structures which are to be removed. The water pressure used in a concrete demolition system would be higher preferably within the range of 20,000 psi to 40,000 psi. In such an application, the lance assembly would be movably mounted on a suitable support adjacent the structure to be demolished.

From the foregoing description, it will be seen that I have provided a highly unique and efficient system for rapidly cleaning castings.

What is claimed is:

1. Apparatus for cleaning castings comprising a cleaning cabinet, a rotary clamping device in the cabinet rotatably clamping a casting to be cleaned, means for rotating said clamping device, an elongate lance projecting into said cabinet and having a high pressure nozzle at its inner end, means connecting the lance to a source of high pressure water for producing a high pressure jet of water directed against a casting to be cleaned, means mounting said lance for pivotal and rotary movement relative to the cabinet, first and second lance pivoting means connected with said lance and each being rapidly actuated to produce rapid pivotal movement of the lance, the actuation time and the magnitude of pivotal movement of the lance produced by said first lance pivoting means differing from that of the second lance pivoting means, programmable control means operatively connected to said first and second lance pivoting means for selectively controlling the rapid actuation times of the first and second lance pivoting means, said control means being programmable to the desired casting height and cleaning cycle time, said first and second lance pivoting means when actuated by said control means producing random movement of the lance relative to a casting to be cleaned for effecting rapid cleaning and programmable to the desired casting height and cleaning cycle time of a casting.

2. The apparatus as defined in claim 1 wherein said rotary clamping device is shiftable between a clamping position for clamping the casting to be cleaned, and a release position for disengagement for a casting.

3. The apparatus as defined in claim 1 wherein said means for rotating said clamping device is reversible for rotating the clamping device in opposite directions during the cleaning operation.

4. The apparatus as defined in claim 2 and a casting support plate in said cabinet, means mounting said plate for free rotation, said clamping device when in the clamping position clamping a casting to be cleaned against said support plate.

5. The apparatus as defined in claim 1 wherein said clamping device comprises a double acting pneumatic piston and cylinder unit.

6. The apparatus as defined in claim 5 wherein said piston and cylinder unit of the clamping device is vertically oriented and includes a piston rod which is vertically shiftable between clamping and release positions.

7. The apparatus as defined in claim 1 and a carriage, means mounting said carriage for reciprocal linear movement of the carriage relative to the cabinet, reversible operating means connected to said carriage for producing linear reciprocating movement of the carriage during the cleaning operation, said lance mounting means and said first and second lance pivoting means being mounted on said carriage whereby the elongate lance is linearly reciprocated simultaneously during random movement of the lance.

8. The apparatus as defined in claim 7 wherein said carriage is vertically reciprocated during the cleaning operation.

9. The apparatus as defined in claim 8 wherein said lance is generally horizontally oriented.

10. The apparatus as defined in claim 1 wherein each of said first and second lance pivoting means comprises a double acting piston and cylinder unit connected to a source of air under pressure.

11. The apparatus as defined in claim 10 wherein the linear stroke of the piston and cylinder unit comprising the first lance pivoting means is different from the linear stroke of the piston and cylinder unit comprising said second lance pivoting means.

12. The apparatus as defined in claim 1 wherein the high pressure water jet directed against a casting to be cleaned by the lance nozzle is at a pressure within the range of 1,000 psi to 20,000 psi.

13. The apparatus as defined in claim 1 wherein the time required to completely clean a casting is within the range of one to six minutes.

14. The apparatus as defined in claim 1 wherein said lance mounting means comprises a spherical bearing permitting pivoting movement of the lance in all directions of approximately 60 ° whereby said first and second lance pivoting means are operable to produce essentially a 60° cone of potential coverage during the cleaning operation.

15. Apparatus for directing a high pressure water jet against a solid target for removing at least some of the material comprising the target, comprising a moveable support, an elongate tubular lance having a high pressure nozzle at one end thereof, means connecting the lance to a source of water under high pressure for directing a jet of water against the target at a pressure within the range of 1,000 psi to 40,000 psi, means mounting said lance for rotary and pivotal movement relative to the support, first and second lance pivoting means connected to with said lance and each being rapidly actuated to produce rapid pivotal movement of the lance, the actuation time and the magnitude of pivotal movement of the lance produced by said first lance pivoting means differing from that of the second lance pivoting means, programmable control means operatively connected to said first and second lance pivoting means for selectively controlling the rapid actuation times of the first and second lance pivoting means, said first and second lance pivoting means when actuated by said control means producing random movement of the lance relative to the target for effecting rapid removal of material comprising the target.

16. The apparatus as defined in claim 15 wherein one of said lance pivoting units is actuated every one tenth second to extend or retract the piston rod thereof, and the other of said lance pivoting units being actuated every 3/10 of a second to extend or retract the piston rod of the other unit.

17. Apparatus for cleaning casting comprising a cleaning cabinet, a vertically disposed clamping device comprising a cylinder and piston unit, said cylinder and piston unit having a vertically shiftable piston rod shiftable between clamping and release positions, a carriage mounted on said cabinet for vertical movement relative thereto, means connected to the carriage for vertically reciprocating the carriage, an elongate tubular lance projecting into the cabinet and having a high pressure nozzle at its inner end, means connecting the lance to a source of high pressure water for delivering a water jet against a casting having a pressure within the range of 8,000 psi to 20,000 psi, means mounting said lance on the carriage for pivotal and rotary movement of the lance relative to the carriage, first and second cylinder and piston units on said carriage connected to the lance, for producing pivotal movement and rotation of the lance, the linear stroke and actuation time of said first unit being different from the linear stroke of said first unit being different from the linear stroke and actuation time of the second unit, programmable control means operatively connected to said first and second lance pivoting units for selectively controlling the actuation times of the first and second lance pivoting units, said first and second lance pivoting units when actuated by said control means producing random movement of the lance relative to a casting to be cleaned for effecting rapid cleaning of a casting.

* * * * *